US012029266B2

(12) United States Patent
Doyle et al.

(10) Patent No.: US 12,029,266 B2
(45) Date of Patent: Jul. 9, 2024

(54) GLOVED WRIST GUARD AND WRIST GUARD

(71) Applicants: Christopher James Doyle, Granger, IN (US); Kevin Michael Doyle, Fort Myers, FL (US)

(72) Inventors: Christopher James Doyle, Granger, IN (US); Kevin Michael Doyle, Fort Myers, FL (US)

( * ) Notice: Subject to any disclaimer, the term of this patent is extended or adjusted under 35 U.S.C. 154(b) by 0 days.

(21) Appl. No.: 18/059,532

(22) Filed: Nov. 29, 2022

(65) Prior Publication Data

US 2023/0165321 A1 Jun. 1, 2023

Related U.S. Application Data

(60) Provisional application No. 63/264,635, filed on Nov. 29, 2021.

(51) Int. Cl.
*A41D 13/08* (2006.01)

(52) U.S. Cl.
CPC ..... *A41D 13/088* (2013.01)

(58) Field of Classification Search
CPC ..... A41D 13/088; A41D 19/01588; A41D 19/01582; A41D 19/0044; A41D 19/015; A41D 19/0048; A63B 71/141
See application file for complete search history.

(56) References Cited

U.S. PATENT DOCUMENTS 5,435,007 A * 7/1995 Kalvestran ..... A41D 13/088 2/161.1
5,492,331 A * 2/1996 Kawakami ..... A41D 13/088 473/212
5,537,692 A * 7/1996 Dorr ..... A41D 19/01588 2/161.1
5,933,868 A * 8/1999 Bender ..... A41D 13/088 2/161.1
6,526,592 B1 * 3/2003 Best ..... A41D 19/01588 2/161.1
6,543,058 B2 * 4/2003 Litke ..... A63B 71/148 2/161.2
6,681,402 B1 * 1/2004 Bevier ..... A63B 71/143 2/19
6,944,884 B1 * 9/2005 Sokolowski ..... A41D 19/01582 2/161.1
7,000,253 B1 * 2/2006 Kleinert ..... A41D 19/01582 2/20
7,475,433 B2 * 1/2009 Coulter ..... A63B 71/141 2/160
8,474,063 B2 * 7/2013 Coulter ..... A63B 71/141 2/160
10,111,477 B1 * 10/2018 Ballas ..... A41F 1/06
2009/0025120 A1 * 1/2009 Vestling ..... A41D 19/01547 2/163

(Continued)

OTHER PUBLICATIONS

Sorbothane(R) Engineering Design Guide, Sorbothane, Inc., 2018.

(Continued)

*Primary Examiner* — Jillian K Pierorazio

(57) ABSTRACT

A wrist guard and a gloved wrist guard are disclosed for providing coverage and protection of the radiocarpal joint including the distal end of the radius, the ulna and the carpal bones as well as the dorsal aspect of the metacarpals.

11 Claims, 8 Drawing Sheets

(56) References Cited

U.S. PATENT DOCUMENTS

| | | | | |
|---|---|---|---|---|
| 2011/0179542 | A1* | 7/2011 | Khuong | A41D 19/01588 2/16 |
| 2012/0198598 | A1* | 8/2012 | Cohen | A41D 19/002 2/160 |
| 2012/0204304 | A1* | 8/2012 | Pechtold | A41D 19/01588 2/16 |
| 2012/0204321 | A1* | 8/2012 | Connelly | A41D 19/04 2/161.6 |
| 2014/0026281 | A1* | 1/2014 | Kleinert | A63B 71/146 2/163 |
| 2014/0215685 | A1* | 8/2014 | Bush | A63B 71/146 2/161.1 |
| 2015/0026866 | A1* | 1/2015 | Swain | A41D 19/015 2/167 |
| 2018/0132553 | A1* | 5/2018 | Quirk | A41D 19/01588 |

OTHER PUBLICATIONS https://pittards.com/pages/sport—webpage for Pittards sport leather sector.

https://pittards.com/pages/gripster—webpage for Pittards gripster leather product.

* cited by examiner

GLOVED WRIST GUARD AND WRIST GUARD

CROSS-REFERENCE TO RELATED APPLICATIONS

This application claims the benefit of U.S. Provisional Application No. 63/264,635, filed on Nov. 29, 2021.

TECHNICAL FIELD OF THE INVENTION

The invention relates to protective apparel, and more particularly to protective apparel for the wrist and hand regions.

BACKGROUND OF THE INVENTION

This section provides background information related to the present disclosure which is not necessarily prior art.

On the market, there are gloves and other devices that provide protection for the wrist and hands while playing contact sports such as hockey and lacrosse. Sports that require more freedom of movement for hands and wrists, such as baseball and softball, have devices on the market that help with grip (gloves), but provide limited hand and wrist protection.

Accordingly, there is a need in the art to provide a protective device with improved hand and wrist protection for playing baseball and softball.

SUMMARY OF THE INVENTION

This section provides a general summary of the disclosure and is not a comprehensive disclosure of its full scope or all of its features.

Embodiments for a wrist guard and a gloved wrist guard are disclosed herein. The configuration of these embodiments allows freedom of movement for the radiocarpal joint and hand while simultaneously providing primary and/or supplementary impact protection from fast-moving sports objects such as, but not limited to, baseballs, softballs, lacrosse balls, hockey pucks and the like.

Freedom of movement is provided by the use of flexible layers of viscoelastic material that surround the radiocarpal joint and covers the dorsal aspect of the hand and fingers. This is in contrast to the conventional use of thick, rigid, hardened material or shells for protection in hockey gloves, lacrosse gloves and tactical gloves.

Primary and/or supplementary impact protection is accomplished by the use of viscoelastic material that deform from an original configuration to dampen and partially absorb the impact of fast-moving objects then regain its original shape after impact.

The wrist guard embodiment provides coverage and protection for the radiocarpal joint including the distal end of the radius and the ulna as well as the carpal bones. The gloved wrist guard provides coverage and protection for the radiocarpal joint including the distal end of the radius, the ulna and the carpal bones as well as the dorsal aspect of the metacarpals and the phalanges.

The gloved wrist guard may be used as a primary layer of protection for the wrist and hand (e.g., in baseball or softball) or it may be used as a supplementary layer of protect for the wrist and hand along with other equipment (e.g., in hockey & lacrosse gloves).

The gloved wrist guard may also have application to other sports such as dirt biking, motocross, mountain biking, road cycling and skiing, by proving additional protection against the impact of bush, sticks, rubble or other debris and from falls or accidents.

It has to be noted that embodiments are described with reference to different subject-matters. However, a person skilled in the art will gather from the above and the following description that, unless otherwise specified, any combination of features belonging to one type of subject-matter as well as any combination between features relating to different subject-matters is considered to be disclosed with this application.

Various aspects of the present invention are defined above; however, further aspects, features and advantages of the present invention may be derived from the examples of the embodiments to be described hereinafter and are explained with reference to examples of embodiments also shown in the figures, but to which the invention is not limited.

Further areas of applicability will become apparent from the description provided herein. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
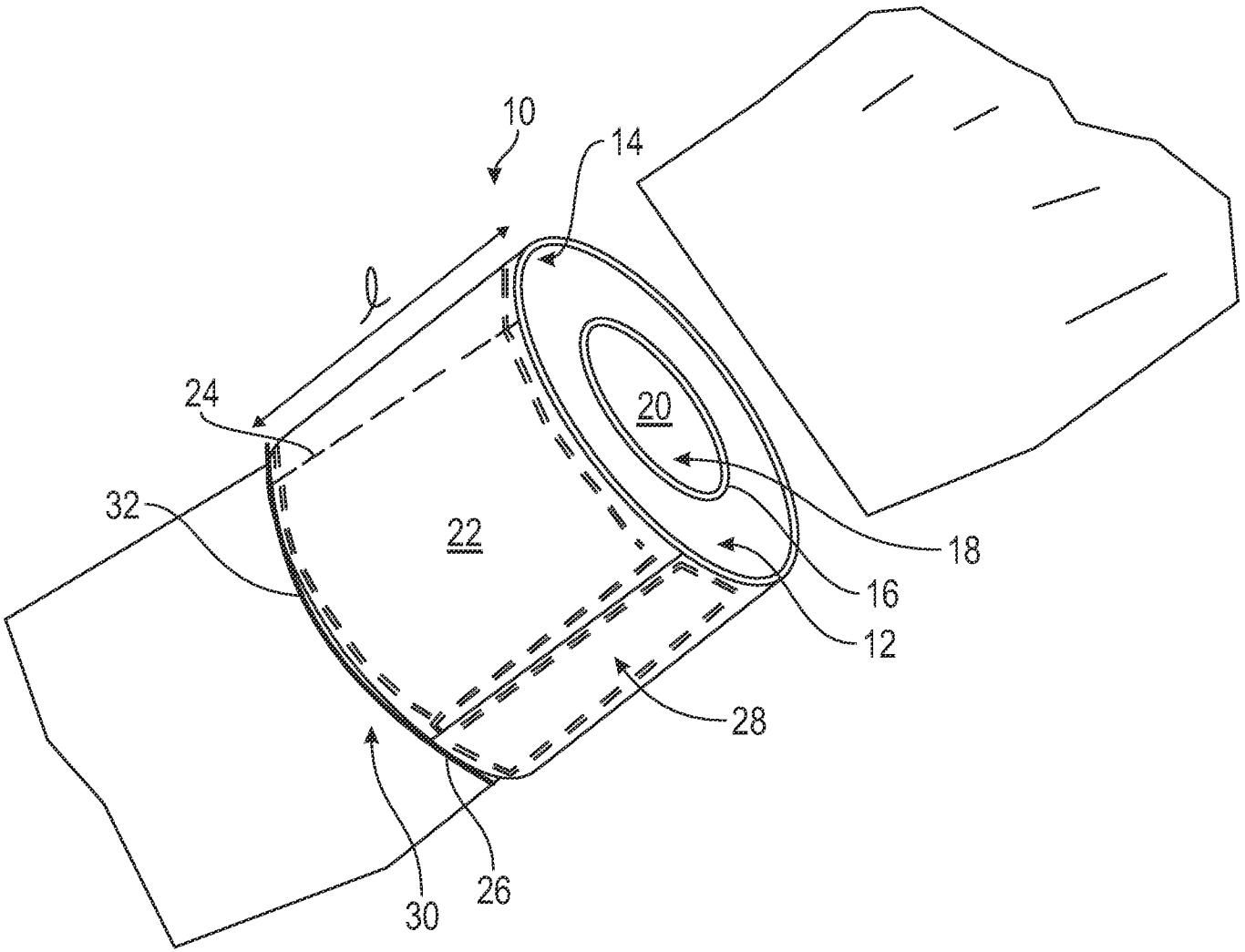
FIG. 1 shows a perspective view of a wrist guard embodiment.

Example embodiments will now be described more fully with reference to the accompanying drawings.

In one embodiment, a wrist guard is provided to protect a radiocarpal joint. The wrist guard includes a viscoelastic sleeve having an outer surface and an inner surface defining a canal extending therethrough for receiving the radiocarpal joint. An inner fabric layer is disposed on the inner surface of the viscoelastic sleeve. An outer elastic layer is disposed on the outer surface of the viscoelastic sleeve and including a fixed end secured to the viscoelastic sleeve, a free end opposite the fixed end and a fastening device at the fixed end for adjustable securing the outer elastic layer over the viscoelastic sleeve.

In another embodiment, a gloved wrist guard is provided to protect a radiocarpal joint and a hand having metacarpals and phalanges. The gloved wrist guard includes a viscoelastic sleeve having an outer surface and an inner surface defining a canal extending therethrough for receiving the radiocarpal joint. An inner fabric layer is disposed on the inner surface of the viscoelastic sleeve. An outer elastic layer is disposed on the outer surface of the viscoelastic sleeve and including a fixed end secured to the viscoelastic sleeve, a free end opposite the fixed end and a fastening device at the fixed end for adjustable securing the outer elastic layer over the viscoelastic sleeve. A glove has a metacarpal portion and five digit portions. A plurality of viscoelastic strips are secured to the glove including at least one transverse metacarpal strip extending from an ulnar side to a radial side of the metacarpal portion of glove and a phalange strip for each of a second, third and fourth digit portions of the glove.

In yet another embodiment, a gloved wrist guard is provided to protect a radiocarpal joint and a hand having metacarpals and phalanges. The gloved wrist guard includes a cuff portion configured to cover the radiocarpal joint of a glove wearer and a glove having a metacarpal portion and a plurality of digit portions extending from the metacarpal portion and terminating at a fingertip. The metacarpal portion is configured to cover the metacarpals of the glove wearer and the digit portions are configured to cover the phalanges of the glove wearer. A viscoelastic pad extends over the cuff portion and the metacarpal portion of the glove and is secured to a dorsal side of the cuff portion and the metacarpal portion of the glove. The viscoelastic pad may include a plurality of viscoelastic strips with each viscoelastic strip having a cuff section extending over the cuff portion and a hand section extending over the metacarpal portion of the glove. The cuff section of the viscoelastic strips is configured to extend parallel to a radius of the glove wearer. The hand section of the viscoelastic strip is configured to extend parallel to an adjacent metacarpal of the glove wearer.

In accordance with the present disclosure, these guards will have a flexible, non-constrictive support layer and impact-absorbing viscoelastic material is strategically secured to the support layer for protecting the radiocarpal joint and carpal bones. Viscoelastic strips extend across the dorsal aspect of the radiocarpal joint, carpal bones and metacarpals bones. In one embodiment, viscoelastic strips may extend along the dorsal aspect of the individual digits (fingers and thumb). An additional strip of impact-absorbing viscoelastic material may extend along the metacarpal bones on the ulnar side of the hand. The viscoelastic material may be a synthetic urethane polymer having shock absorbing and damping characteristics. It has been determined that the impact-absorbing viscoelastic material (Sorbothane®) available from Sorbothane, Inc. is particularly well-suited for this application. Sorbothane is a polyether-based polyurethane formulated for enhanced viscoelastic properties which is consistently effective over a wide temperature range (0° F. to 160° F.). Because Sorbothane is a non-Newtonian material, stress is not proportional to strain and mechanical energy is "lost" by conversion to heat.

Thread stitching for the entire glove may be in the form of a double top row stitch with the straight stiches 1/16" to 1/8" apart which will provide adequate flexibility, while maintaining sufficient durability to keep the position of the viscoelastic material intact.

A hook and loop fastening system may be used to secure the wrist portion of the guard.

In the gloved wrist guard embodiment, the wrist portion of the guard may be attached directly to the glove portion of the guard using the same stitching as described above. The unstitched areas of the wrist portion allow for the fastening device to be adjusted as needed.

A strip of binding may be sewn along the proximal end of the wrist guard to provide a finished look and durability for an area of the glove that will experience frequent grasping and pulling as the guard is being put on and adjusted.

In accordance with the present disclosure, these guards may be provided in left-hand or right-hand versions and may also be provided in various wrist/hand sizes, such as small (S), medium (M), large (L), extra-large (XL) and extra extra-large (XXL or XL+) to accommodate a range of anatomical dimensions.

Example embodiments will now be described more fully with reference to the accompanying drawings. There is no intention to be limited by any principle presented in the preceding background or the following detailed description.

Figure 10:
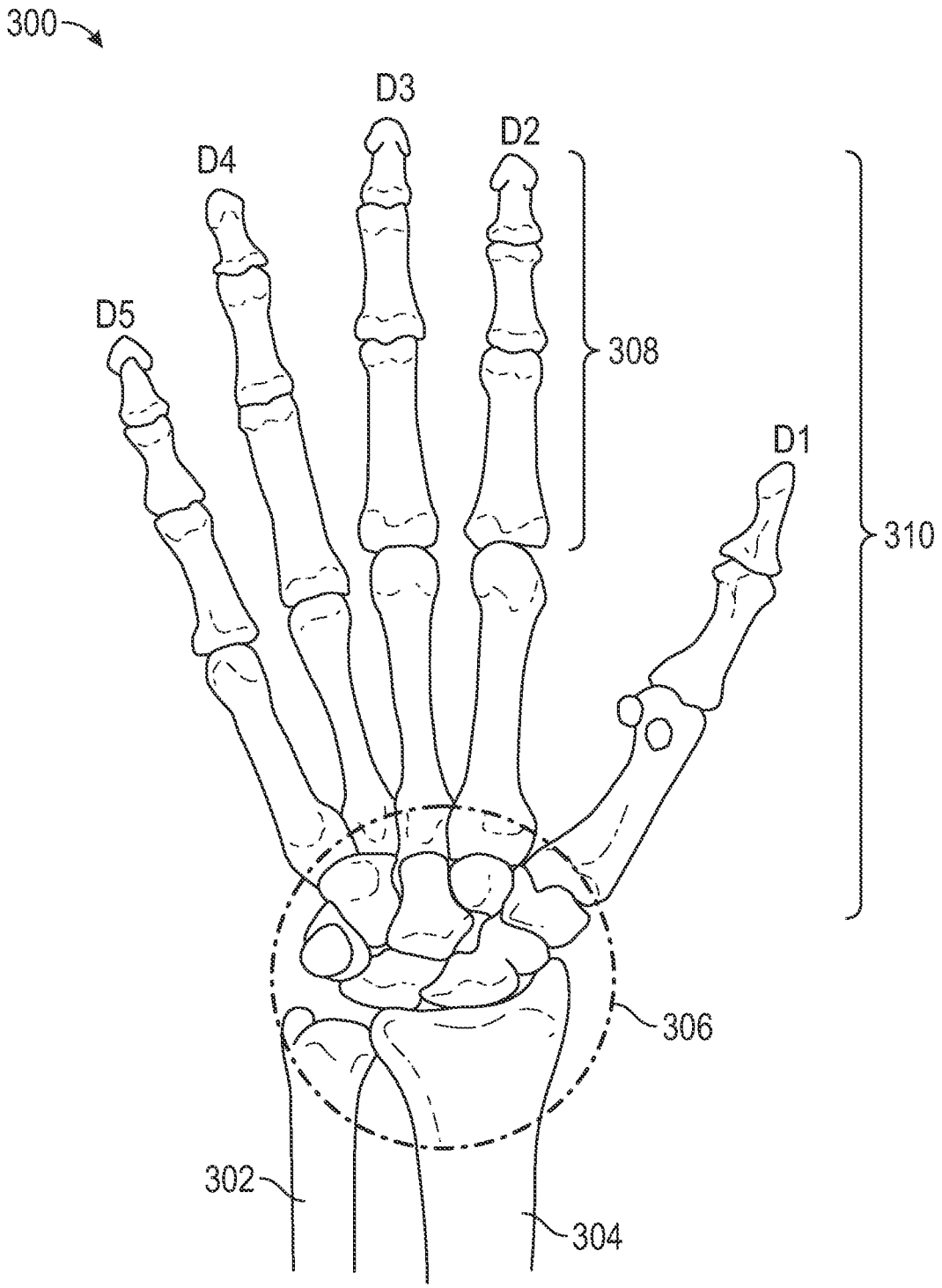
FIG. 10 (Prior Art)
FIG. 10 is an illustration of the dorsal aspect of a human arm extremity including the ulna, radius, radiocarpal joint and hand.

With reference now to FIGS. 1 and 10, a wrist guard 10 is configured to protect a radiocarpal joint. The wrist guard 10 includes a viscoelastic sleeve 12 having an outer surface 14 and an inner surface 16 defining a canal 18 extending therethrough for receiving the radiocarpal joint. An inner fabric layer 20 is disposed on and secured to the inner surface 16 of the viscoelastic sleeve 12. An outer elastic layer 22 is disposed on and partially secured to the outer surface 14 of the viscoelastic sleeve 12. The outer elastic layer 22 includes a fixed end 24 secured to the viscoelastic sleeve 12 and a free end 26 opposite the fixed end 24. A fastening device 28 is formed at the free end 26 for adjustably securing the outer elastic layer 22 over the viscoelastic sleeve 12. Stitching for the wrist guard is shown as double dashed lines (═══) in FIG. 1.

In one embodiment, the fastening device 28 includes a hook substrate disposed in a first region of the outer elastic layer 22 and a loop substrate disposed in a second region of the outer elastic layer 22. The hook substrate interlocks with the loop substrate when placed in contact with one another for securing the wrist guard 10 on the user over the radiocarpal joint. A suitable hook and loop fastening system for securing the wrist portion of the guard may include VELCRO® brand re-closeable fastening strips.

In one embodiment, the viscoelastic sleeve 12 is configured to extend over and cover the styloid process of the ulna and the styloid process of the radius. The viscoelastic sleeve may have a length (I) of about four inches.

In one embodiment, the wrist guard 10 may include a leather binding 30 disposed on a proximal end 32 of the viscoelastic sleeve 12 and interconnecting the inner fabric layer 20 and the outer elastic layer 22.

Figure 2:
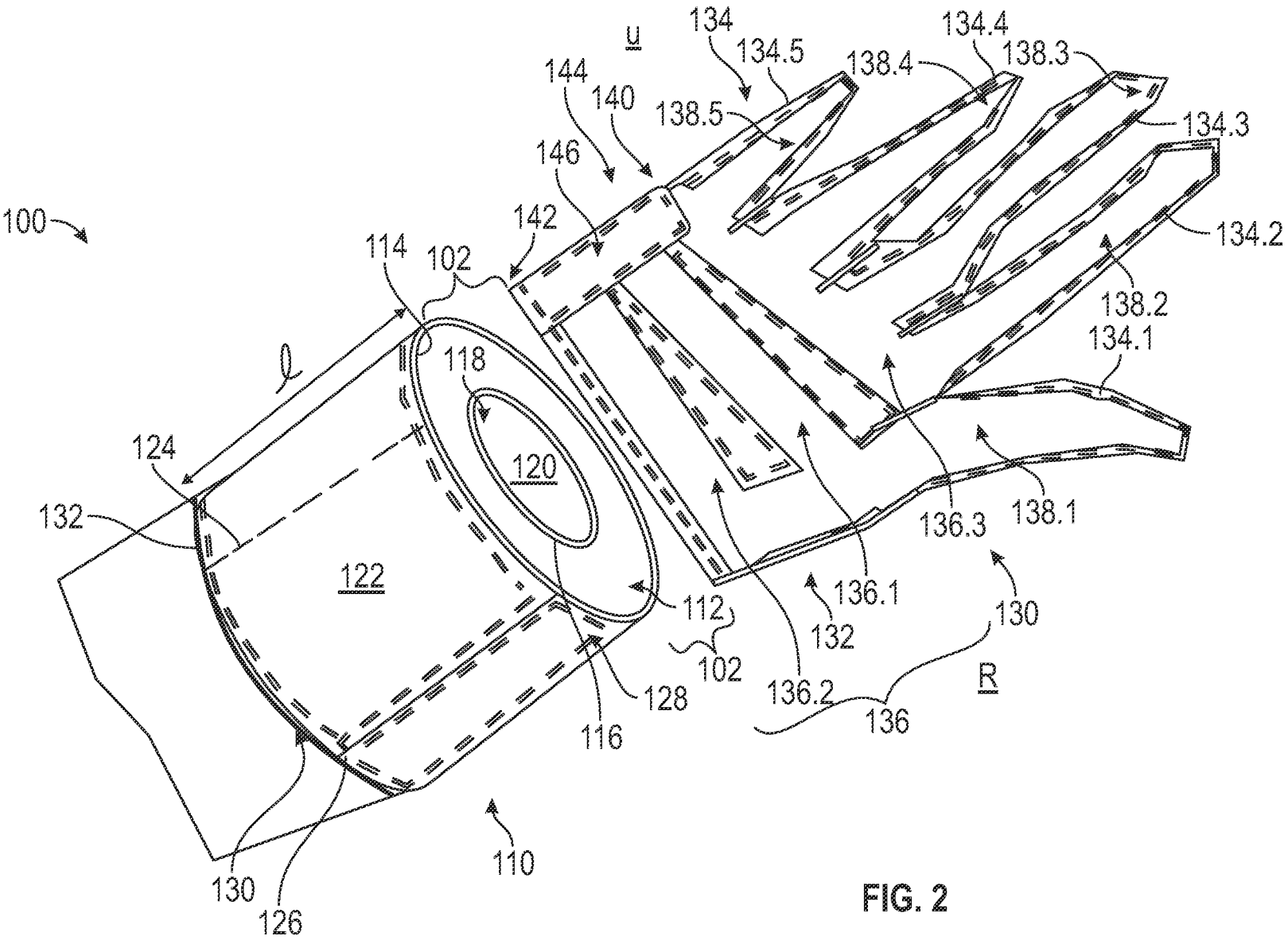
FIG. 2 shows a perspective view of a gloved wrist guard embodiment.

With reference now to FIGS. 2 and 10, a gloved wrist guard 100 is configured to protect a radiocarpal joint and a hand having metacarpals and phalanges. The gloved wrist guard 100 includes a wrist guard 110 and a glove 130. A viscoelastic sleeve 112 having an outer surface 114 and an inner surface 116 defining a canal 118 extending therethrough for receiving the radiocarpal joint. An inner fabric layer 120 is disposed on and secured to the inner surface 116 of the viscoelastic sleeve 112. An outer elastic layer 122 is disposed on the outer surface 114 of the viscoelastic sleeve 112 and includes a fixed end 124 secured to the viscoelastic sleeve 112 and a free end 126 opposite the fixed end 124. A fastening device 128 is formed at the free end 126 for adjustably securing the outer elastic layer 122 over the viscoelastic sleeve 112. A glove 130 includes a metacarpal portion 132 and five digit portions 134.1-134.5 (collectively 134). A plurality of viscoelastic strips are secured to the glove 130. At least one transverse metacarpal strip 136 extends from an ulnar side (U) to a radial side (R) on the metacarpal portion 132 of glove 130. A phalange strips 138 extend axially on the digit portions 134 of the glove 130. Stitching for the gloved wrist guard is shown as double dashed lines (═══) in FIG. 1.

In one embodiment, the gloved wrist guard 100 includes a fabric cuff 102 (schematically represented by brackets in FIG. 2) extending from the glove 130 and interconnecting with the wrist guard 110.

In one embodiment, a first metacarpal strip 136.1 extends from the ulnar side (U) to a radial side (R) over a knuckle region 140 between the metacarpal portion 132 and the digit portions 134 of the glove 130. A second metacarpal strip 136.2 extends from the ulnar side (U) to a radial side (R) over a base region 142 on the metacarpal portion 132 of the glove 130 opposite the digit portions 134. A third metacarpal strip 136.3 extends from the ulnar side (U) to a radial side (R) over a mid-region 144 between the base region 142 and the knuckle region 140 of the glove 130.

In one embodiment, a phalange strip 138.2 extends on a second digit portion 134.2, a phalange strip 138.3 extends on a third digit portion 134.3 and a phalange strip 138.4 extends on the fourth digit portions 134.4 of the glove 130. The embodiment may further include a phalange strip 138.1 extending on the first digit portion 134.1 and a phalange strip 138.5 extending on the fifth digit portion 134.5 of the glove 130.

In one embodiment, the gloved wrist guard 100 includes a lateral metacarpal strip 146 extending along the ulnar side (U) on the metacarpal portion 132 of the glove 130.

Figure 4:
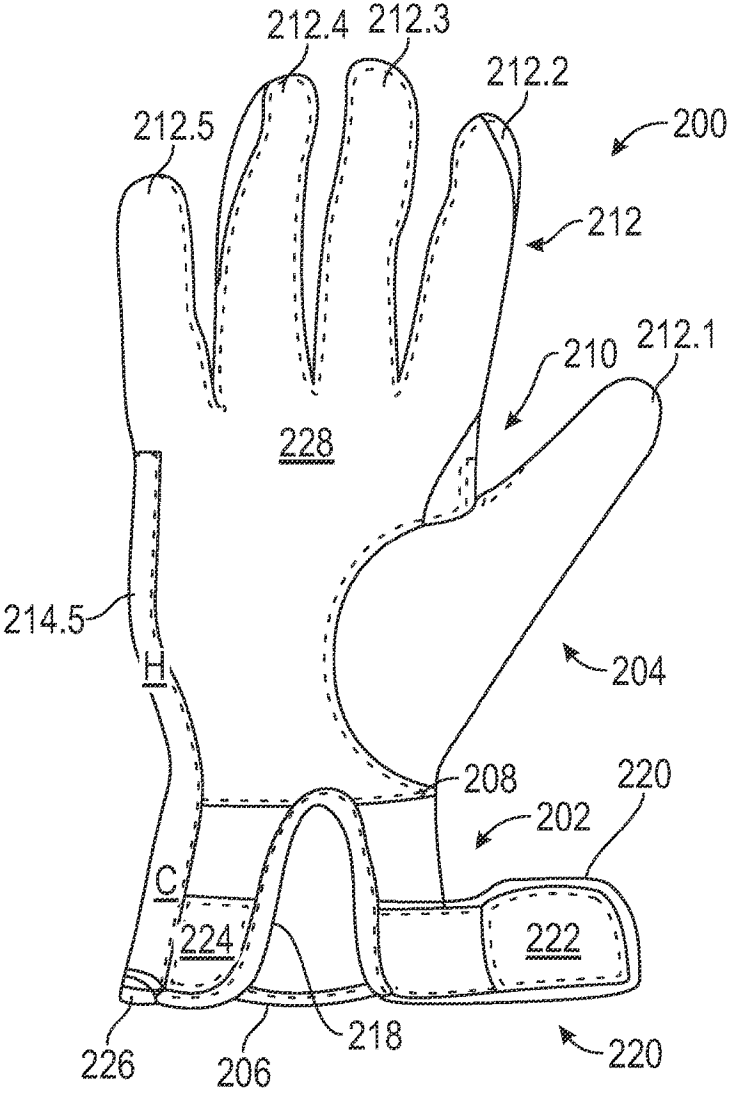
FIG. 4 shows a palmar (volar) view of the gloved wrist guard shown in FIG. 3.
Figure 3:
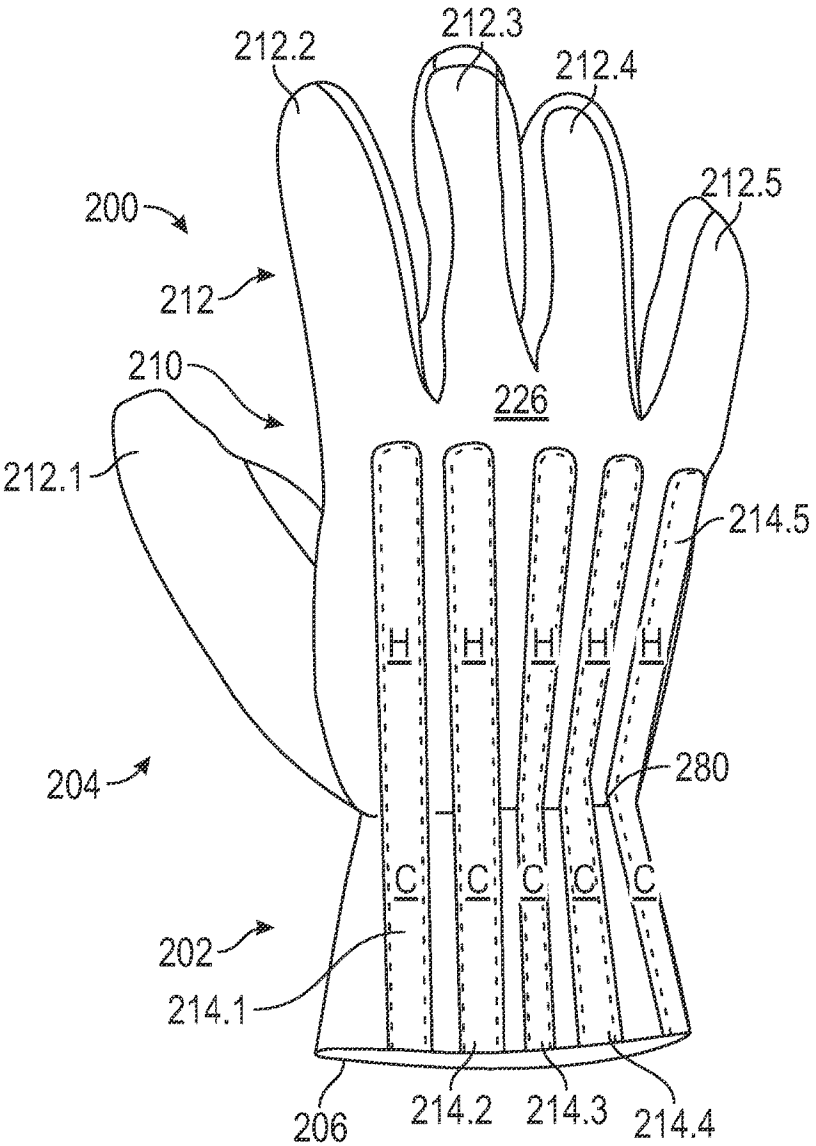
FIG. 3 shows a dorsal view of another gloved wrist guard embodiment.

With reference now to FIGS. 3-4 and 10, a gloved wrist guard 200 is configured to protect the carpal bones forming a radiocarpal joint and a hand having metacarpals and phalanges. The gloved wrist guard 200 includes a cuff portion 202 extending distally from a proximal end 204 above the styloid processes of the ulna and the radius to cover the radiocarpal joint and terminating at a distal end 206. A glove 208 includes a metacarpal portion 210 extending distally from the distal end 206 of the cuff portion 202 for covering the metacarpal region of the hand and five digit portions 212.1-212.5 (collectively 212) extending distally from the metacarpal portion 210, each digit portion 212 terminating at the distal phalanx (i.e., fingertips). Five viscoelastic strips 214.1-214.5 (collectively viscoelastic pad 214) extend over the cuff portion 202. Specifically, the viscoelastic pad 214 extend distally from the proximal end 204 of the cuff portion 202 and over the metacarpal portion 210 of the glove 208 and terminate at the metacarpophalangeal joints (knuckles). Each viscoelastic strip 214 has a cuff section C extending over the cuff portion 202 and a hand section H extending over the metacarpal portion 210 of the glove 208. The cuff sections C are configured to extend generally parallel to the radius bone of the glove wearer. The hand sections H of the viscoelastic strips 214 are configured to extend generally parallel to the adjacent metacarpal of the glove wearer.

While not shown in FIG. 3, viscoelastic strips may also be secured on an outer surface of the digit portions 212 of the glove 208 similar to that shown in FIG. 2.

Figure 6:
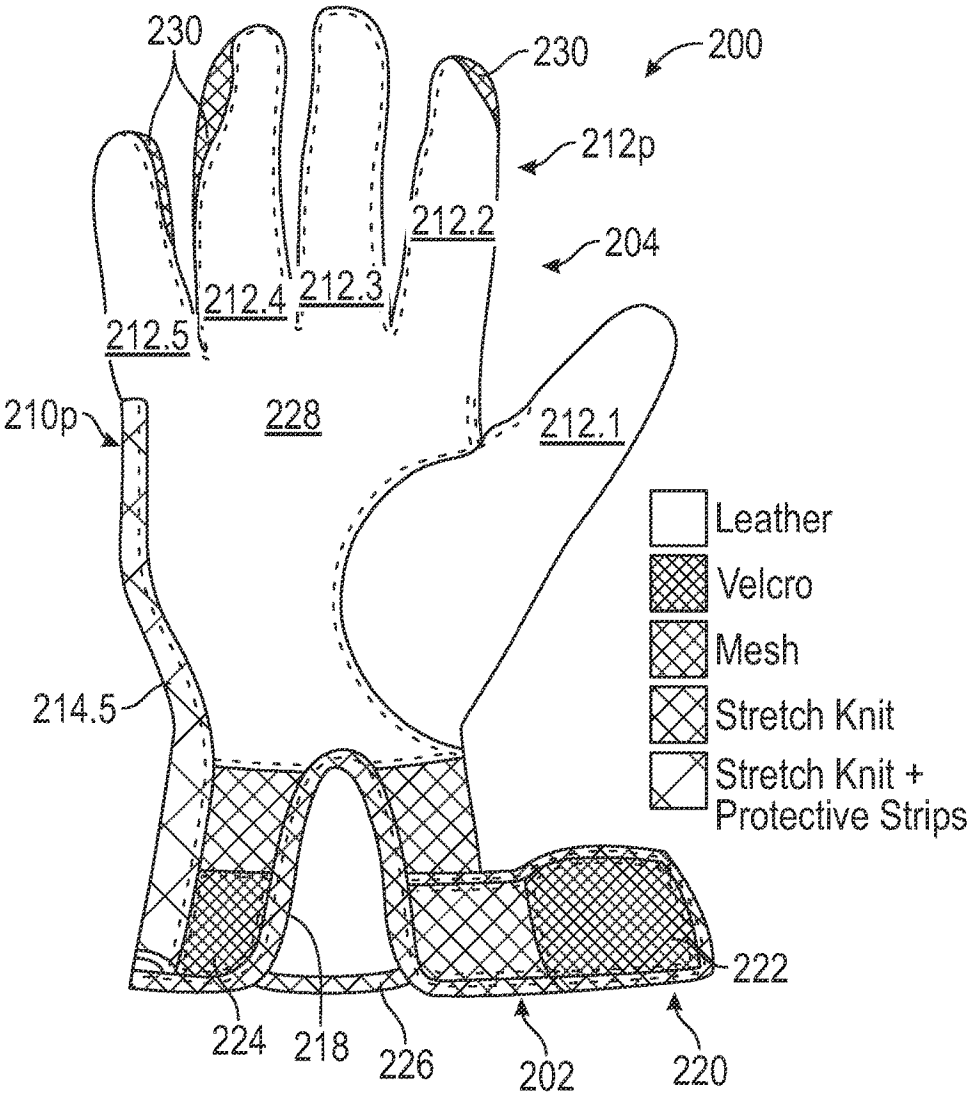
FIG. 6 shows the material selection for the gloved wrist guard in FIG. 4.
Figure 5:
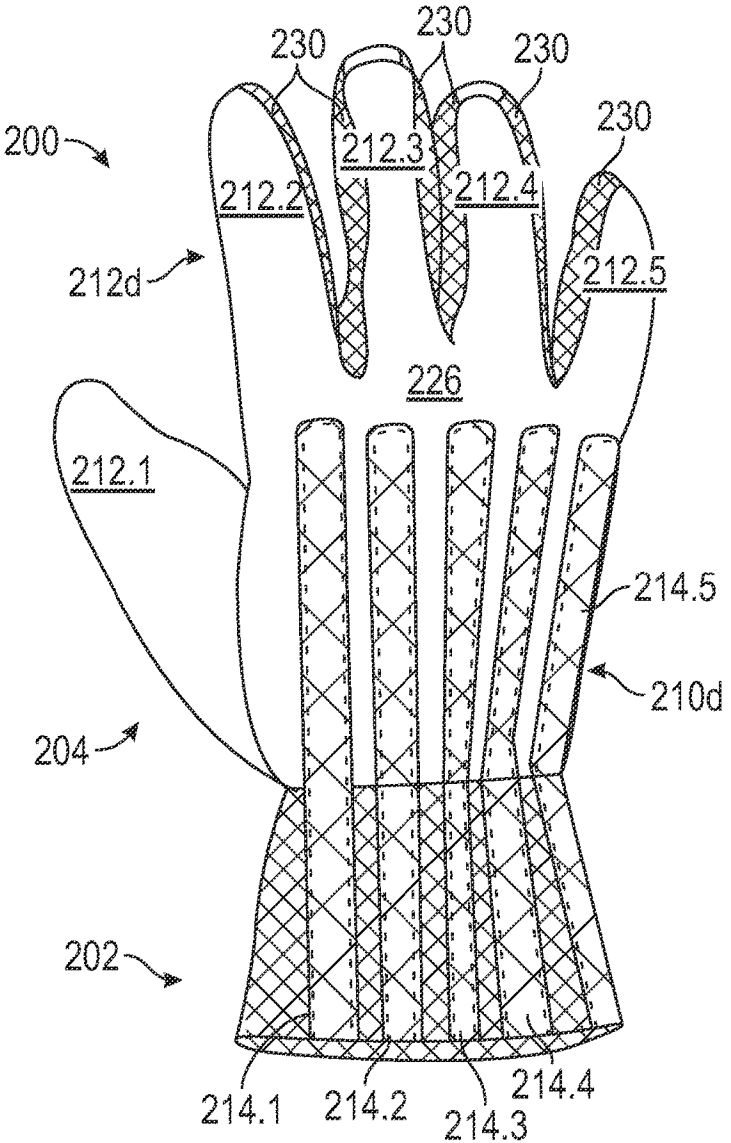
FIG. 5 shows the material selection for the gloved wrist guard in FIG. 3

With reference now to FIGS. 4-6, the cuff portion 202 is made using a stretch knit fabric and is generally annular in shape. A notch 218 is formed on the palmar side of the cuff portion 202. A strap 220 is disposed on one side of the notch 218 and has a loop-type fastener 222 secured to the end thereof. A compatible hook-type fastener 224 is secured adjacent the notch 218 opposite the strap 220. In this way, the strap 220 may be wrapped around the wrist drawing the notch 218 together and the loop-type fastener 222 can be releasably secured to the hook-type fastener 224 for appending the gloved wrist guard 200 cover a user's hand. A binding 226 is stitched over the free end proximal end 204 of the cuff portion.

The glove 208 is made using a natural leather or synthetic leather-like material, for example Gripster™ glove leather available from Pittards PLC. The glove 208 has a dorsal side 226 (FIG. 5) including a metacarpal portion **210*d* and digit portions 212*d* and a palmar side 228 (FIG. 6) including a metacarpal portion 210*p* and digit portions 212*p*. The first digit portion 212.1 of the glove 208 defines the thumb of the glove 208 and is secured to the palmar side 228 of the metacarpal portion 210*p*. Elastic mesh panels 230 are secured between the dorsal side 226 and the palmar side 228 of the remaining digit portions 212.2-212.5. As noted above, four viscoelastic strips 214.1-214.4 are secured to an outer surface on the dorsal side 226 of the glove 208. The fifth viscoelastic strip 214.5 is secured to the outer surface on the dorsal side of the glove 208 and has a width sufficient to wrap around the ulnar side of the glove 208** for providing additional protection of the fifth metacarpal.

Figure 7:
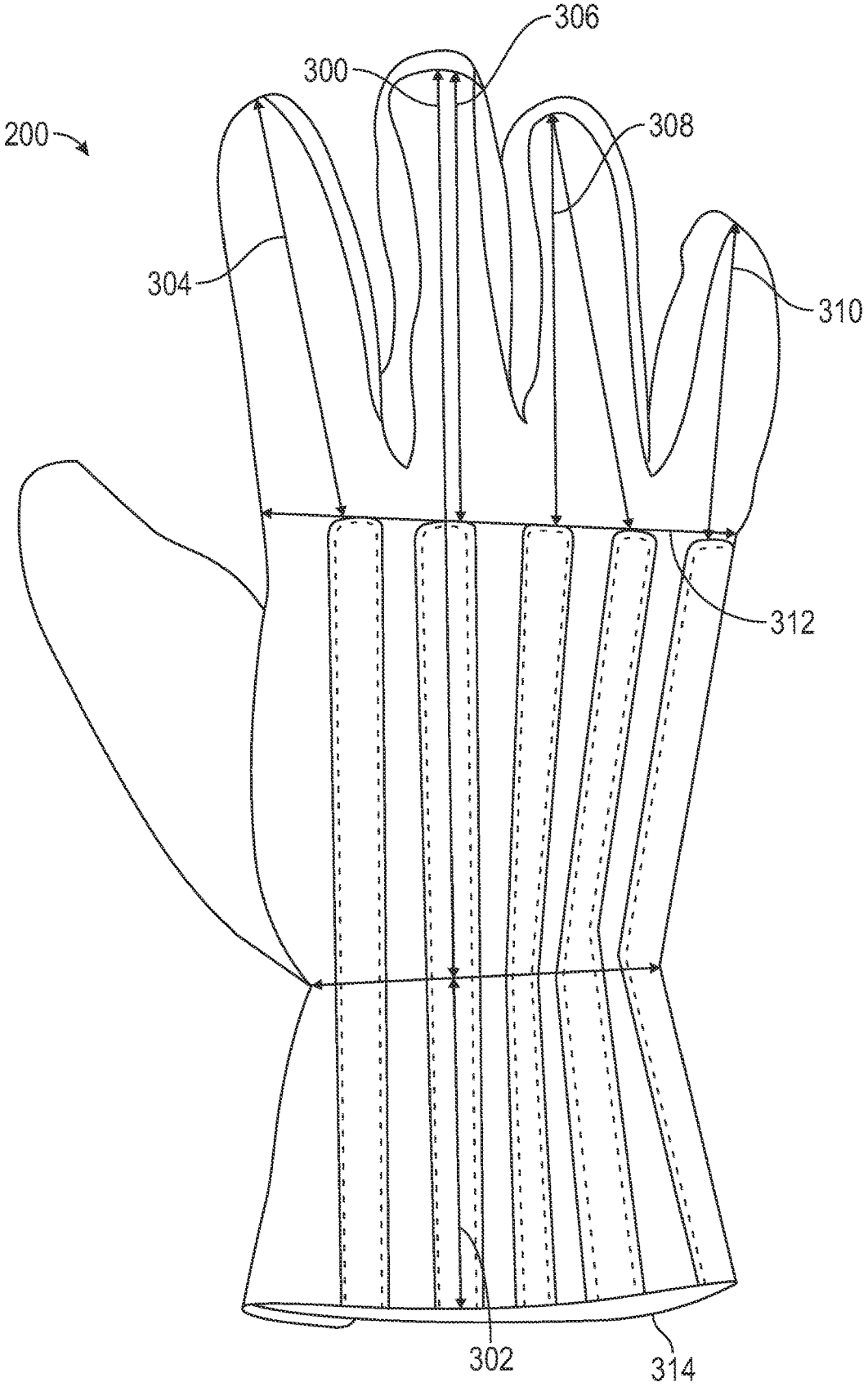
FIGS. 7-9 illustrate the dimensional aspects of the gloved wrist guard in FIG. 3.
Figure 8:
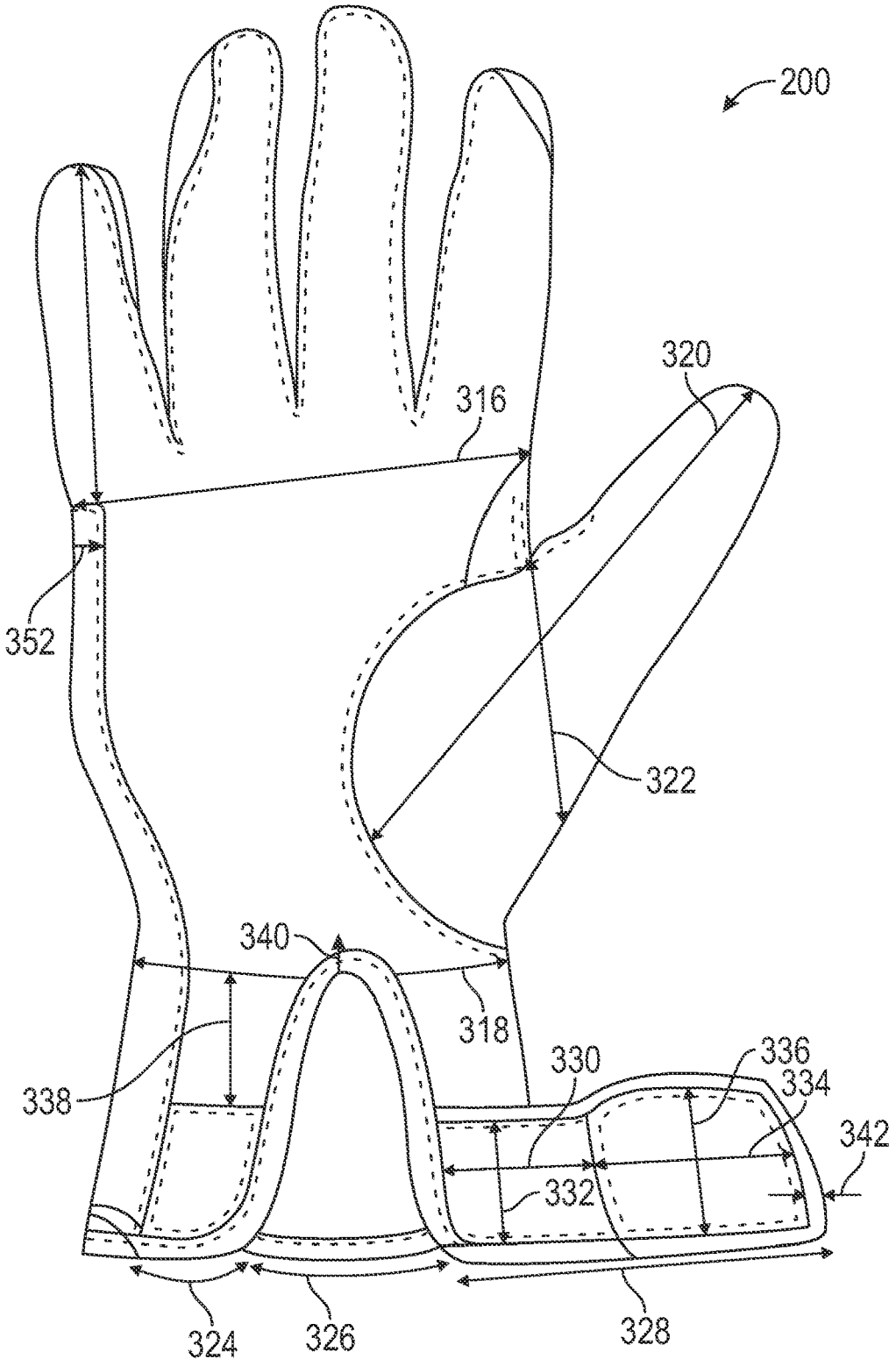
Figure 9:
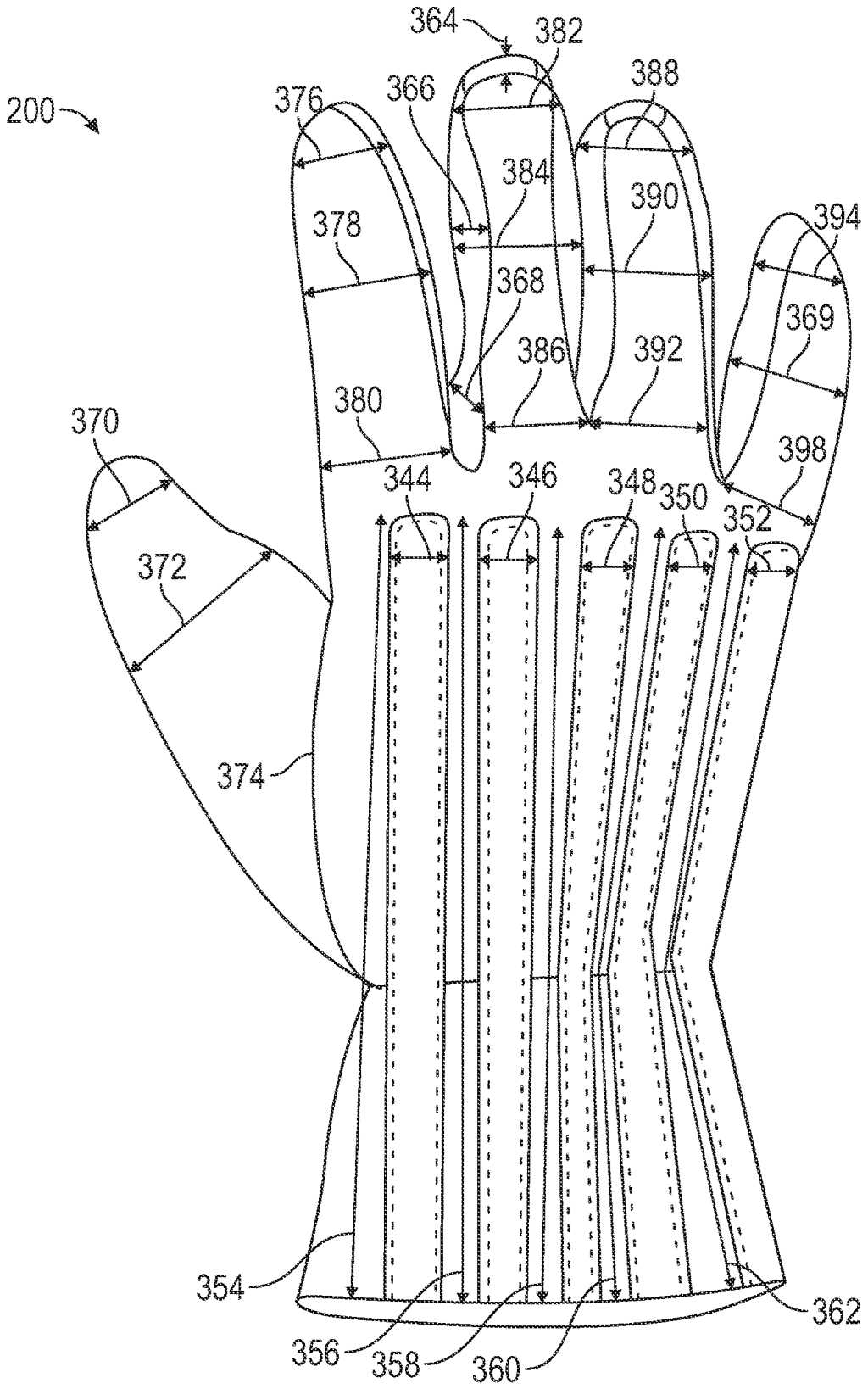

With reference now to FIGS. 7-9, representative dimensions for an extra-large (XL) gloved wrist guard are provided in the tables below.

| Ref. No. | Description | Dimension (inch) |
|---|---|---|
| 300 | Fingertip to Wrist Seam | 8 |
| 302 | Wrist Seam to Finish | 4 |
| 304 | Fingertip to Top of Strip | 4 |
| 306 | Fingertip to Top of Strip | 4.25 |
| 308 | Fingertip to Top of Strip | 4.5 |
| 310 | Fingertip to Top of Strip | 3.5 |
| 312 | Width @ Knuckles | 5.25 |
| 314 | Circumference @ Binding | |
| | (closed) | 8.5 |
| | (open) | 18.5 |
| 316 | Width @ Knuckles | 4 |
| 318 | Circumference @ Wrist Seam | 10.25 |
| 320 | Thumb Length | 5.75 |
| 322 | Thumb Width @ Joint | 2 |
| 324 | Width @ Back Binding | 0.5 |
| 326 | Width @ Middle Binding | 0.5 |
| 328 | Width of Strap (on top) Including fastener | 10 |
| 330 | Width of Strap (hem) Including fastener | 10.5 |
| 332 | Height of Strap | 2 |
| 334 | Width of Loop | 1.5 |
| 336 | Height of Loop | 1.83 |
| 338 | Placement of Loop Below Wrist Seam | 1.75 |
| 340 | Binding Placement Above Wrist Seam | 0.5 |
| 342 | Binding Width | 0.25 |
| 344 | Width of Strip | 0.5 |
| 346 | Width of Strip | 0.5 |
| 348 | Width of Strip | 0.5 |
| 350 | Width of Strip | 0.5 |
| 352 | Width of Strip | 1.5 |
| 354 | Length of Strip | 8.5 |
| 356 | Length of Strip | 8.125 |
| 358 | Length of Strip | 7 |
| 360 | Length of Strip | 6.75 |
| 362 | Length of Strip | 6.5 |
| 364 | Mesh Width @ Fingertip | 0.125 |
| 366 | Mesh Width @ 1" down | 0.5 |
| 368 | Mesh Width In Between Fingers | 0.5 |
| 370 | Width @ ¼" Down | 1 |
| 372 | Width @ 1" Down | 1.5 |
| 374 | Width @ 3" Down | 5 |
| 376 | Width @ ¼" Down | 1 |

-continued

| Ref. No. | Description | Dimension (inch) |
|---|---|---|
| 378 | Width @ 1" Down | 1.5 |
| 380 | Width @ 3" Down | 1.125 |
| 382 | Width @ ¼" Down | 1.125 |
| 384 | Width @ 1" Down | 1.25 |
| 386 | Width @ 3" Down | 1.25 |
| 388 | Width @ ¼" Down | 1 |
| 390 | Width @ 1" Down | 1.25 |
| 392 | Width @ 3" Down | 2.5 |
| 394 | Width @ ¼" Down | 1 |
| 396 | Width @ 1" Down | 1.25 |
| 398 | Width @ 3" Down | 1 |

The thickness of the viscoelastic strips are preferably 0.25" but may be varied as needed to provide adequate impact protection while maintaining sufficient flexibility for the gloved wrist guard. The glove size may be modified for a smaller (S, M, L) or larger size (XXL) using acceptable anatomical scaling factors.

FIG. 10 illustrates the dorsal aspect of a human arm extremity 300 including the ulna 302, the radius 304, the radiocarpal joint 306 including the carpal bones with their associated tendons and ligaments (not shown) and the metacarpals/phalanges 308 including a thumb (D1), index finder (D2), long finger (D3), ring finger (D4) and short finger (D5) which make up the hand 310. The phalanges 308 include the two phalanx bones in the thumb and the three phalanx bones in each finger.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure

The invention claimed is:

1. A gloved wrist guard configured to protect a radiocarpal joint and a hand having metacarpals and phalanges, the gloved wrist guard comprising:

a cuff portion extending from a proximal end to a distal end and configured to cover the radiocarpal joint of a glove wearer;

a glove having a metacarpal portion extending from the distal end of the cuff portion and a plurality of digit portions extending from the metacarpal portion, wherein the metacarpal portion is configured to cover the metacarpals of the glove wearer and the digit portions are configured to at least partially cover the phalanges of the glove wearer; and a viscoelastic pad extending over the cuff portion and the metacarpal portion of the glove, wherein the viscoelastic pad includes a viscoelastic ulnar strip extending distally in the direction of the metacarpals from the radiocarpal joint, wherein the viscoelastic ulnar strip is secured to a dorsal side of the cuff and metacarpal portions of the glove and wraps around an ulnar side of the glove for providing flexible impact protection thereto.

2. The gloved wrist guard according to claim 1, wherein the viscoelastic pad further comprises a plurality of separate viscoelastic dorsal strips secured to a dorsal side of the glove for providing flexible impact protection thereto, each viscoelastic strip having a cuff section extending distally over the cuff portion and a hand section extending distally over the metacarpal portion of the glove.

3. The gloved wrist guard according to claim 2, wherein the cuff section is configured to extend parallel to a radius of the glove wearer and the hand section is configured to extend parallel to an adjacent metacarpal of the glove wearer.

4. The gloved wrist guard according to claim 2, wherein the viscoelastic pad comprises:

a first viscoelastic dorsal strip extending from the proximal end of the cuff portion over the metacarpal portion of the glove and terminating below the digit portions;

a second viscoelastic dorsal strip extending from the proximal end of the cuff portion over the metacarpal portion of the glove and terminating below the digit portions;

a third viscoelastic dorsal strip extending from the proximal end of the cuff portion over the metacarpal portion of the glove and terminating below the digit portions; and a fourth viscoelastic dorsal strip extending from the proximal end of the cuff portion over the metacarpal portion of the glove and terminating below the digit portions.

5. The gloved wrist guard according to claim 1, wherein the cuff portion comprises a strap is disposed on a side of a notch formed in the cuff portion, a first fastener secured to an end of the strap, and a second fastener secured adjacent the notch opposite the strap, wherein the strap wraps around the cuff portion for drawing the notch together with the first and second fasteners releasably together.

6. The gloved wrist guard according to claim 1, wherein the cuff portion is fabricated using a stretch knit fabric and the glove is fabricated using a glove leather material.

7. The gloved wrist guard according to claim 6, wherein the glove further comprises an elastic mesh panel extending between a dorsal side and a palmar side of at least one digit portion.

8. The gloved wrist guard according to claim 1, further comprising a binding secured around the proximal end of the cuff portion.

9. The gloved wrist guard according to claim 1, wherein the viscoelastic pad further comprises a viscoelastic dorsal strip extending distally in the direction of the metacarpals from the radiocarpal joint and secured to a dorsal side of the glove for providing flexible impact protection thereto, wherein the viscoelastic ulnar strip and the viscoelastic dorsal strip are separate.

10. A gloved wrist guard configured to protect a radiocarpal joint and a hand having metacarpals and phalanges, the gloved wrist guard comprising:

a cuff portion extending from a proximal end to a distal end and configured to cover the radiocarpal joint of a glove wearer;

a glove having a metacarpal portion extending from the distal end of the cuff portion and a plurality of digit portions extending from the metacarpal portion, each digit portion terminating at a fingertip, wherein the metacarpal portion is configured to cover the metacarpals of the glove wearer and the digit portions are configured to cover the phalanges of the glove wearer; and a plurality of separate viscoelastic strips secured to a dorsal side of the cuff and metacarpal portions of the glove, each viscoelastic strip having a cuff section extending distally over the cuff portion and a hand section extending distally over the metacarpal portion of the glove, the plurality of viscoelastic strips comprising:

a first viscoelastic strip having a first cuff section configured to extend parallel to a radius of the glove wearer and a first hand section configured to extend parallel to a first metacarpal of the glove wearer;

a second viscoelastic strip having a second cuff section configured to extend parallel to the radius of the glove wearer and a second hand section configured to extend parallel to a second metacarpal of the glove wearer;

a third viscoelastic strip having a third cuff section configured to extend parallel to the radius of the glove wearer and a third hand section configured to extend parallel to a third metacarpal of the glove wearer;

a fourth viscoelastic strip having a fourth cuff section configured to extend parallel to the radius of the glove wearer and a fourth hand section configured to extend parallel to a fourth metacarpal of the glove wearer; and a fifth viscoelastic strip having a fifth cuff portion and a fifth hand section, wherein the fifth viscoelastic strip is secured to the dorsal side of the cuff and metacarpal portions of the glove and wraps around an ulnar side of the glove for providing flexible impact protection thereto.

11. The gloved wrist guard according to claim 10, wherein the cuff portion comprises a strap is disposed on a side of a notch formed in the cuff portion, a first fastener secured to an end of the strap, and a second fastener secured adjacent the notch opposite the strap, wherein the strap wraps around the cuff portion for drawing the notch together with the first and second fasteners releasably together.

* * * * *